2/11/86 CP 4,569,776

United States Patent [19]

Miller et al.

[11] Patent Number: 4,569,776

[45] Date of Patent: Feb. 11, 1986

[54] WATER-BASED HYDRAULIC FLUID COMPOSITIONS CONTAINING SELECTED TWO-COMPONENT ANTI-WEAR AGENTS

[75] Inventors: Philip R. Miller, Hamden; Richard M. Mullins, Madison, both of Conn.

[73] Assignee: Olin Corporation, Cheshire, Conn.

[21] Appl. No.: 715,223

[22] Filed: Mar. 22, 1985

[51] Int. Cl.[4] ..... C10M 129/50; C10M 133/12; C10M 135/10; C10M 173/00

[52] U.S. Cl. ..... 252/77; 252/47.5; 252/48.2; 252/48.6; 252/49.3; 252/50; 252/51.5 R; 252/51.5 A; 252/57; 252/75; 252/76; 252/79; 252/54.6

[58] Field of Search ..... 252/47.5, 48.2, 48.6, 252/49.3, 50, 51.5 R, 51.5 A, 54.6, 57, 75, 76, 77, 79

[56] References Cited

U.S. PATENT DOCUMENTS

| | | | |
|---|---|---|---|
| 2,330,239 | 9/1943 | Prutton | 252/54.6 |
| 3,227,652 | 1/1966 | Ackerman | 252/49.3 |
| 3,245,909 | 4/1966 | Lowe | 252/51.5 A |
| 3,826,746 | 7/1974 | Schick et al. | 252/51.5 A |
| 4,347,148 | 8/1982 | Davis | 252/50 |
| 4,434,066 | 2/1984 | Lewis | 252/77 |

FOREIGN PATENT DOCUMENTS 1099620 1/1968 United Kingdom .

*Primary Examiner*—Paul Lieberman
*Assistant Examiner*—Robert A. Wax
*Attorney, Agent, or Firm*—William A. Simons; Thomas P. O'Day

[57] ABSTRACT

Disclosed is an improved water-based hydraulic fluid composition which comprises an aqueous composition having a viscosity of at least 5 centistokes at 40° C. which contains up to about 95 percent by weight of water, at least 0.1 percent by weight of a carboxylic acid lubricity agent, and an effective amount of at least one selected anti-wear additive; wherein the improvement comprises:

said anti-wear agent comprising the combination of:

(a) an aromatic compound containing one to three electron-releasing substituent components, wherein said electron-releasing substituents are selected from the group consisting of amino, alkyl-substituted amino having 1 to about 12 carbon atoms, amido groups of the formula —NHC-(=O)R wherein R is an alkyl group having 1 to about 12 carbon atoms, alkoxy having 1 to about 12 carbon atoms, and mixtures thereof; with (b) an aromatic compound containing one to three electron-withdrawing substituent components, wherein said electron-withdrawing substituents are selected from the group consisting of nitro, cyano, sulfo, and mixtures thereof.

13 Claims, No Drawings

WATER-BASED HYDRAULIC FLUID COMPOSITIONS CONTAINING SELECTED TWO-COMPONENT ANTI-WEAR AGENTS

BACKGROUND OF THE INVENTION

1. Field of the Invention

The present invention relates to improved water-based hydraulic fluid compositions containing selected two-component anti-wear agents.

2. Description of the Prior Art

U.S. Pat. No. 4,434,066, which issued to Lewis on Feb. 28, 1984, discloses a water-based energy transmitting fluid (i.e. water-based hydraulic fluid) which comprises an aqueous composition having a viscosity of at least 10 centistokes at 40° C. and contains (a) up to about 80% by weight water, (b) at least 0.1% by weight of an acidic lubricity agent, and (c) a minimally effective amount of an anti-wear additive (or agent) which comprises (i) a hydroxyl-substituted aromatic carboxylic acid component and (ii) a nitroaromatic compound component.

Although the two-component anti-wear agents disclosed in this Lewis patent do have apparent utility as anti-wear agents, there is still a need in the art for other anti-wear agents which are more effective and more economical to use.

It is an object of the present invention to make effective and economic anti-wear agents from other combinations of aromatic compounds.

BRIEF SUMMARY OF THE INVENTION

The present invention, therefore, is directed to an improved water-based hydraulic fluid composition which comprises an aqueous composition having a viscosity of at least 5 centistokes at 40° C. which contains up to about 95 percent by weight of water, at least 0.1 percent by weight of a conventional acidic lubricity agent and an effective amount of at least one selected anti-wear agent, wherein the improvement comprises:

said anti-wear agent comprising the combination of:

(a) an aromatic compound containing one to three electron-releasing substituents, wherein said electron-releasing substituents are selected from the group consisting of amino, alkyl-substituted amino having 1 to about 12 carbon atoms, amido groups of the formula —NHC(=O)R wherein R is an alkyl group having 1 to about 12 carbon atoms, alkoxy having 1 to about 12 carbon atoms, and mixtures thereof; with (b) an aromatic compound containing one to three electron-withdrawing substituent components, wherein said electron-withdrawing substituents are selected from the group consisting of nitro, cyano, sulfo (—$SO_3H$), and mixtures thereof.

Also provided in accordance with the present invention is a method for enhancing the anti-wear properties of water-based hydraulic fluid compositions containing an acidic lubricity agent which comprises incorporating into said hydraulic fluid effective amount of at least one selected anti-wear agent, said anti-wear agent comprising the combination of:

(a) an aromatic compound containing one to three electron-releasing substituents, wherein said electron-releasing substituents are selected from the group consisting of amino, alkyl-substituted amino having 1 to about 12 carbon atoms, amido groups of the formula —NHC(=O)R wherein R is an alkyl group having 1 to about 12 carbon atoms, alkoxy having 1 to about 12 carbon atoms, and mixtures thereof; with (b) an aromatic compound containing one to three electron-withdrawing substituent components, wherein said electron-withdrawing substituents are selected from the group consisting of nitro, cyano, sulfo (—$SO_3H$), and mixtures thereof.

DETAILED DESCRIPTION

As used in the present specification and claims, the term "aromatic compound" is intended to include any and all compounds made up of one or more benzene rings which have the desired substituents thereto. Specifically, the substituted aromatic compounds which constitute components (a) and (b) of the anti-wear agents of the present invention may be mononuclear in nature (i.e. containing one benzene ring) or polynuclear (i.e. containing two or more connected or fused benzene rings such as in naphthalene, anthracene, phenanthrene or bisphenyl). Preferably, the aromatic compounds contain from 6 to about 12 ring carbon atoms. The electron-releasing (i.e. amino, alkyl-substituted amino, amido and alkoxy) substituents of component (a) donate electrons to their aromatic ring, while the electron-withdrawing (i.e. nitro, cyano, and sulfo) substituents in component (b) withdraw electrons from their aromatic ring. The interactions between (a) and (b) components are believed to be responsible for the enhanced anti-wear performance of the present invention.

Preferred classes of substituted aromatic compounds for component (a) include mononuclear aromatic compounds like benzoic acids, aromatic sulfonic acids, phenyl alkyl acids and substituted benzenes. Examples of these preferred component (a) molecules include the following:

1. Mono-, di-, and triaminobenzoic acids such as o-aminobenzoic acid, p-aminobenzoic acid, 3,4-diaminobenzoic acid.

2. Alkyl-substituted ($C_1$ to $C_{12}$ atoms) mono-, di-and triaminobenzoic acids such as 3-dimethylaminobenzoic acid.

3. Mono-, di-, and trialkoxy ($C_1$ to $C_{12}$ atoms) benzoic acids such as o-methoxybenzoic acid, p-methoxybenzoic acid and p-n-butoxy benzoic acid.

4. Mono-, di-, and triamino-substituted phenyl alkyl ($C_1$ to $C_{12}$ atoms) acids such as o-aminophenylacetic acid.

5. Mono-, di-, and trialkoxyl-substituted ($C_1$ to $C_{12}$ atoms) phenyl alkyl ($C_1$ to $C_{12}$ atoms) acids such as m-methoxy-cinnamic acid.

6. Mono-, di-, and triamido-substituted ($C_1$ to $C_{12}$ atoms) benzoic acids such as o-acetaminobenzoic acid.

7. Mono-, di-, and triamino(aromatic)sulfonic (—$SO_3H$) acids such as o-aminobenzenesulfonic acid, and p-aminobenzenesulfonic acid (also known as sulfanilic acid).

One class of preferred component (a) compounds is para-substituted benzoic and benzene sulfonic acids. It is believed that having the electron-releasing substituent in the para-position to the acid group results in better anti-wear performance. Another class of preferred component (a) compounds is alkoxy-substituted benzoic and benzenesulfonic acids wherein the alkoxy substituent has at least 4 carbon atoms such as n-butoxy. It is believed that the longer the carbon chain in the alkoxy group, the better the anti-wear performance.

The most preferred component (a) compounds of the present invention include p-aminobenzoic acid, 3,4-diaminobenzoic acid, p-n-butoxybenzoic acid and p-aminobenzenesulfonic acid.

Preferred classes of substituted aromatic compounds for component (b) include mononuclear aromatic compounds like benzoic acids, aromatic sulfonic acids, phenyl alkyl acids and benzenes. Examples of these preferred component (b) molecules include the following:

1. Mono-, di-, and trinitrobenzoic acids such as p-nitrobenzoic acid and 3,5-dinitrobenzoic acid.
2. Mono-, di-, and tricyanobenzoic acid such as p-cyanobenzoic acid.
3. Mono-, di-, and trinitrophenols such as p-nitrophenol and 2,4,6-trinitrophenol (picric acid).
4. Mono-, di-, and trinitrobenzenes such as nitrobenzene.
5. Mono-, di-, and tricyanobenzenes such as benzonitrile.
6. Mono-, di-, and trisulfo (—$SO_3H$)-substituted benzoic acid such as o-sulfobenzoic acid.

One class of preferred component (b) compounds are para-substituted benzoic and benzenesulfonic acids. It is believed that having the electron-withdrawing substituent in the para-position to the acid group results in the most effective anti-wear performance.

The most preferred component (b) compounds are p-cyanobenzoic acid and p-nitrobenzoic acid.

It should be noted that both component (a) and (b) compounds may contain other substituents (e.g. methyl groups as in 2-methyl-3-nitrobenzoic acid) as long as such groups do not substantially prevent the electron-releasing or electron-withdrawing groups from effectively functioning for their desired purposes. It should also be noted that the alkali metal, alkaline earth metal, amine or ammonium salt forms of the the above-noted acid compounds for both (a) and (b) may also be used.

Representative combinations which may be used as anti-wear agents of the present invention include the following:

| Component (a) | Component (b) |
|---|---|
| o-Aminobenzenesulfonic Acid | 3,5-Dinitrobenzoic Acid |
| p-Aminobenzoic Acid | 3,5-Dinitrobenzoic Acid |
| o-Aminobenzoic Acid | 3,5-Dinitrobenzoic Acid |
| p-n-Butoxybenzoic Acid | p-Nitrobenzoic Acid |
| p-Aminobenzoic Acid | 2,4,6-trinitrophenol |
| p-Aminobenzenesulfonic Acid | p-Cyanobenzoic Acid |
| 3-Dimethylaminobenzoic Acid | p-Nitrobenzoic Acid |
| o-Acetaminobenzoic Acid | p-Nitrobenzoic Acid |
| 3-Dimethylaminobenzoic Acid | p-Nitrobenzoic Acid |
| o-Methoxybenzoic Acid | 3,5-Dinitrobenzoic Acid |
| p-Methoxybenzoic Acid | p-Nitrobenzoic Acid |
| p-Aminobenzoic Acid | o-Sulfobenzoic Acid |

In compositions of this invention, it is essential that both the component (a) and the component (b) be present in order to prepare water-based hydraulic fluid compositions that exhibit enhanced anti-wear and lubricity properties. As a general rule, the combination of anti-wear additive components hereinabove described should be present in a combined amount sufficient to impart the desired degree of anti-wear properties and lubricity to the hydraulic fluids. This will also depend upon the other constituents in the composition, the operating conditions, and the service requirements for the particular application that the hydraulic fluid is employed in. The combined amount of components (a) and (b) should be an "effective amount" which is defined as being any amount capable of achieving the anti-wear properties and lubricity required for that particular application. Preferably, it is desirable in any application to employ the combination of these two components in a "minimally effective amount" which is defined as being the minimum amount capable of achieving the anti-wear properties and lubricity required for that particular application. While the "effective amount" and "minimally effective amount" will vary depending upon the application, the preferred amounts of each of the additive components present should be at least about 0.0025 gram-moles per liter (generally about 0.003% by weight) and preferably from about 0.01 to about 0.50 or more, gram-moles per liter of aqueous composition (generally between about 0.01% to about 10% by weight). Except for the requirements given above, the relative proportions of and the maximum amount of each of these components and the combination thereof that should be present is not critical to the present invention. Economic factors also help determine what optimum amounts should be used.

The water-based compositions of the invention should have a viscosity of at least 5, preferably at least 10 centistokes at 40° C. and may contain up to about 95 percent by weight of water. In general, the viscosity of the aqueous composition of the invention may vary depending upon the energy transmission application of which it is intended and the temperature range over which it will be used. For example, energy transmitting fluids such as hydraulic fluids may preferably have viscosities in the range of about 25 to 150 centistokes at 40° C., and more preferably in the range of about 30 to 85 centistokes at that temperature. While it is desirable to be able to provide an energy transmitting fluid which contains the greatest amount of water in order to provide fire resistant characteristics, it is also important that such fluid have a viscosity range that is capable of operating in existing equipment, as well as providing adequate boundary lubrication and lubrication for mechanical components. Accordingly, the water content of the compositions of the invention may vary in the range of from about 20 percent to about 95 percent, and preferably from about 30 percent to about 70 percent by weight.

To achieve the range of viscosities that may be desired for a particular application and wherein the water content of such compositions may be varied over a broad range, a water-soluble polymeric viscosity control and/or thickening agent may be generally employed in an amount that preferably ranges from about 2 percent to 50 percent and more preferably from about 10 to 20 percent by weight of the composition.

Suitable water-soluble polymers that may be used as viscosity control agents include poly(alkylene oxide) polymers, urethane polyalkyl methacrylates, polyamide esters and polyamide alkoxylates. Furthermore, the hydraulic fluids of the present invention may also preferably contain conventional additives including water-soluble freezing point depressants; corrosion, oxidation and foam inhibitors; pH conditioners; dyes; sequestering agents; and the like.

The acidic lubricity agents suitable for use in compositions of the invention are well known materials which are conventionally used as lubricity improvers in water-based hydraulic fluids and the like. Such suitable acidic materials include, for example, saturated and unsaturated aliphatic carboxylic and polycarboxylic acids having at least 2 carbon atoms such as caproic acid, caprylic acid, pelargonic acid, capric acid, lauric acid, myristic acid, palmitic acid, stearic acid, oleic acid, linoleic acid, undecanoic acid, oxalic acid, malonic acid, succinic acid, glutaric acid, adipic acid, maleic acid, fumaric acid, glutaconic acid, butenetricarboxylic acid, aromatic carboxylic acids such as benzoic acid, dimethylbenzoic acid, phthalic acid, terephthalic acid, isophthalic acid and trimellitic acid; alkali metal or organic amine salts (e.g. morpholine) of said aliphatic and aromatic carboxylic acids; polymerized fatty acids (dimer acids); oxycarboxylic acids such as maleic and tartaric acid; and lecto-dicarboxylic acids such as acetonedicarboxylic acid.

As a general rule, the acidic lubricity agent may be present in an amount between about 0.1 and 10 percent by weight and are conventionally used in an amount between about 0.5 and 2 percent by weight of the water-based composition, but greater amounts of said agent may be employed if desired for particular applications.

In preparing the water-based compositions of the invention, each of the components used may be added in any order of addition, or combinations of some of them may be prepared prior to incorporating in the hydraulic fluid composition. Also, it may be preferable that each of the components to be used be water-soluble or previously made into a water-soluble form such as the alkali metal or ammonium salts thereof or should be capable of being solubilized in situ. Other conventional hydraulic fluid ingredients as disclosed in the above-discussed Lewis patent may also be employed herein. The Lewis patent is incorporated herein by reference in its entirety.

The following Examples further illustrate the present invention. All parts and percentages are by weight unless explicitly stated otherwise.

EXAMPLES 1-12

The following examples illustrate the effectiveness of the claimed two-component anti-wear agents in hydraulic pump tests run as described in the procedure below. Molecules containing electron-releasing groups are identified by an (a) and molecules containing electron-withdrawing groups are identified by a (b). Both molecules must be present.

Measurement of the anti-wear properties of the agents of this invention in hydraulic fluid compositions, as well as the Comparison compositions, were performed on a hydraulic fluid test stand as described in ASTM D-2882-83 "Indicating the Wear Characteristics of Petroleum and Non-Petroleum Hydraulic Fluids in a Constant Volume Vane Pump". The operational conditions for these tests were as follows:

| | |
|---|---|
| Pump | Vickers V-104-C-10 (8 gpm) Vane Pumps |
| Pump Speed | 1200 RPM |
| Pump Pressure | 141 kg/cm$^2$ (2000 psig) |
| Fluid Temperature | 66° C. (150° F.) |
| Fluid Quantity | 13.25 liters (3.5 gal.) |

The apparatus and procedure described in ASTM D2882-83 and the above conditions were used to evaluate the wear of metal cam ring and vanes using various water-based compositions of this invention.

The ingredients used in preparing the compositions evaluated in these Examples, with the exception of the anti-wear additives of the present invention, are known to those skilled in the art, and are typically used in water-based hydraulic fluid compositions. POLY-G® WT-90,000 is a polymeric water soluble thickening agent made up of 75% EO and 25% PO (random) by weight and initiated from diethylene glycol and commercially available from Olin Corporation of Stamford, Conn. Diethylene glycol (DEG) is used as a freezing point and pour point depressant in water-based hydraulic fluids. REOMET 42 (a triazole derivative) is a copper corrosion inhibitor and is available commercially from Ciba-Geigy Corporation of Ardsley, N.Y. Aliphatic fatty acids such as pelargonic acid as well as aromatic carboxylic acids such as benzoic acid are used as acidic lubricity agents. In order to be soluble in aqueous-based systems, these acidic lubricity agents are commonly present as sodium, potassium or alkanolamine salts. SYNKAD 202 is a ferrous corrosion inhibitor and available commercially from Keil Chemical of Hammond, Ind. (division of Ferro Corporation). Other ferrous corrosion inhibitors used were triethanolamine, methyldiethanolamine and morpholine. The amounts of water in these Examples (about 40–42% by weight) were sufficient to obtain hydraulic fluids of the fire-resistant type. The results of these experiments are shown in Tables I and II below. The amounts for each ingredient in the formulations shown are in weight percent.

In general, if the measured mg wear to the ring and vanes is less than about 100 mg for a 6 hour test, or less than about 500 mg for a 100 hours test, then that is a good indication that the anti-wear agent used is very effective. When comparing the test results contained in Table I and II, it can be seen that the wear data obtained using formulations containing the two-component anti-wear agent of the present invention were typically 100 mg or lower per 6 hours, whereas the wear data obtained using formulations which do not contain these two-component anti-wear agents typically were 1000 mg or higher per 6 hours of testing (except for Comparison 5). This clearly demonstrates the benefits of the present invention.

It should be noted that some of the Comparison formulations in Table II varied slightly from the formulations in Table I. For example, other copper corrosion inhibitors such as disodium 2,5-dimercaptothiadiazole were also used instead of REOMET 42. Potassium laurate is used as an acidic lubricity agent. Disodium EDTA is a known chelating agent. It is not believed that o-chlorobenzoic acid, potassium acid phthalate and 3-nicotinic acid contain effective electron-releasing or electron-withdrawing groups.

TABLE I

| Ingredients, Weight % | 1 | 2 | 3 | 4 | 5 | 6 | 7 | 8 | 9 | 10 | 11 | 12 |
|---|---|---|---|---|---|---|---|---|---|---|---|---|
| Water, De-ionized | 41.71 | 41.72 | 41.71 | 41.72 | 41.55 | 40.74 | 41.72 | 41.72 | 41.52 | 41.71 | 41.70 | 40.50 |
| POLY-G WT-90,000 | 15.90 | 15.90 | 15.90 | 15.90 | 15.73 | 15.90 | 15.90 | 15.90 | 15.83 | 15.90 | 15.90 | 16.12 |
| Diethylene Glycol | 38.41 | 38.41 | 38.41 | 38.40 | 38.01 | 38.41 | 38.40 | 38.40 | 38.24 | 38.41 | 38.40 | 38.61 |
| REOMET 42 | 0.10 | 0.10 | 0.10 | 0.10 | 0.10 | 0.10 | 0.10 | 0.10 | 0.10 | 0.10 | 0.10 | 0.10 |
| Pelargonic Acid | 1.00 | 1.00 | 1.00 | 1.00 | 0.68 | 1.00 | 1.00 | 1.00 | 0.78 | 1.00 | 0.73 | 0.70 |
| Benzoic Acid | 0.01 | — | — | 0.01 | — | 0.01 | 0.01 | 0.01 | — | 0.01 | — | — |
| Triethanolamine | 2.60 | 2.60 | 2.60 | 2.60 | — | 2.60 | 2.60 | 2.60 | 3.28 | 2.60 | 2.79 | 2.70 |

TABLE I-continued

| Ingredients, Weight % | 1 | 2 | 3 | 4 | 5 | 6 | 7 | 8 | 9 | 10 | 11 | 12 |
|---|---|---|---|---|---|---|---|---|---|---|---|---|
| Methyldiethanolamine | — | — | — | — | 2.57 | — | — | — | — | — | — | — |
| Morpholine | — | — | — | — | 0.78 | 0.80 | — | — | — | — | — | 0.80 |
| SYNKAD 202 | — | — | — | — | 0.20 | 0.20 | — | — | — | — | — | 0.20 |
| (a) 3-dimethylaminobenzoic Acid | 0.07 | — | — | — | — | — | — | — | — | — | — | — |
| (b) p-Cyanobenzoic Acid | — | — | — | — | — | 0.17 | — | — | — | — | — | — |
| (b) p-Nitrobenzoic Acid | 0.20 | — | — | — | — | — | 0.20 | 0.20 | 0.17 | — | 0.20 | — |
| (b) 2,4,6-trinitrophenol | — | — | 0.21 | — | — | — | — | — | — | — | — | — |
| (a) p-Aminobenzoic Acid | — | 0.07 | 0.07 | — | — | — | — | — | — | — | — | 0.07 |
| (a) o-Aminobenzenesulfonic Acid | — | — | — | 0.07 | — | — | — | — | — | — | — | — |
| (b) 3,5-Dinitrobenzoic Acid | — | 0.20 | — | 0.20 | — | — | — | — | — | 0.20 | — | — |
| (a) p-aminobenzenesulfonic Acid | — | — | — | — | 0.21 | 0.07 | — | — | — | — | — | — |
| (b) p-Nitrophenol | — | — | — | — | 0.17 | — | — | — | — | — | — | — |
| (a) o-Aminophenylacetic Acid | — | — | — | — | — | — | 0.07 | — | — | — | — | — |
| (a) o-Acetamidobenzoic Acid | — | — | — | — | — | — | — | 0.07 | — | — | — | — |
| (a) p-n-Butoxybenzoic Acid | — | — | — | — | — | — | — | — | 0.08 | — | — | — |
| (a) o-Methoxybenzoic Acid | — | — | — | — | — | — | — | — | — | 0.07 | — | — |
| (a) p-Methoxybenzoic Acid | — | — | — | — | — | — | — | — | — | — | 0.18 | — |
| (b) o-sulfobenzoic Acid | — | — | — | — | — | — | — | — | — | — | — | 0.20 |
| Total Cam Ring and Vanes Wear | | | | | | | | | | | | |
| mg wear/6 hours | 58 | <10 | <10 | <10 | N.T. | <10 | <10 | 40 | <10 | 69 | 39 | 50 |
| mg wear/100 hours | N.T.[1] | 40 | 95 | 107 | 84 | <10 | N.T. | N.T. | 67 | N.T. | 50 | N.T. |

[1]N.T. - Not Tested

Comparisons C1–C6

C-1 to C-4 are comparative examples, conducted in accordance with the same above described procedure, which demonstrate the ineffectiveness of similar formulations where the present two-component anti-wear agent is not employed. C-5 and C-6 are comparative examples, also conducted in accordance with the same procedure, which demonstrate the widely varying results or inconsistency of anti-wear actively of the paired components disclosed in the Lewis patent.

TABLE II

| Ingredients, Weight % | C-1 | C-2 | C-3 | C-4 | C-5 | C-6 |
|---|---|---|---|---|---|---|
| Water, De-ionized | 41.50 | 41.71 | 41.71 | 41.71 | 41.51 | 40.50 |
| POLY-G WT-90,000 | 15.75 | 15.90 | 15.90 | 15.90 | 16.00 | 16.05 |
| Diethylene Glycol | 37.75 | 38.41 | 38.41 | 38.41 | 38.51 | 38.56 |
| REOMET-42 | — | 0.10 | 0.10 | 0.10 | 0.10 | 0.10 |
| Disodium 2,5-dimercapto-thiadiazole | 0.15 | — | — | — | — | — |
| Potassium Laurate | 1.30 | — | — | — | — | — |
| Pelargonic Acid | — | 1.00 | 1.00 | 1.00 | 1.00 | 0.70 |
| SYNKAD 202 | 0.30 | — | — | — | — | 0.20 |
| Morpholine | 0.60 | — | — | — | — | 0.80 |
| Triethanolamine | 2.60 | 2.60 | 2.60 | 2.60 | 2.60 | — |
| Diethanolamine | — | — | — | — | — | 2.70 |
| Disodium EDTA | 0.05 | — | — | — | — | — |
| Benzoic Acid | — | 0.01 | 0.01 | 0.01 | 0.01 | — |
| Salicylic Acid | — | 0.07 | — | 0.07 | 0.07 | — |
| o-Chlorobenzoic Acid | — | 0.20 | — | — | — | — |
| 3,5-Dinitrobenzoic Acid | — | — | 0.20 | — | 0.20 | — |
| p-Nitrobenzoic Acid | — | — | — | — | — | 0.21 |
| Potassium Acid Phthalate | — | — | 0.07 | — | — | — |
| 3-Nicotinic Acid | — | — | — | 0.20 | — | — |
| p-Hydroxybenzoic Acid | — | — | — | — | — | 0.18 |
| Total Cam Ring and Vanes Wear mg wear/6 hours | 855 | 1035 | 1153 | 1115 | 67 | 338 |

What is claimed is:

1. In a water-based hydraulic fluid composition which comprises an aqueous composition having a viscosity of at least 5 centistokes at 40° C. which contains up to about 95 percent by weight of water, at least 0.1 percent by weight of a carboxylic acid lubricity agent and an effective amount of an anti-wear agent, wherein the improvement comprises:

said anti-wear agent comprising the combination of:

(a) at least about 0.0025 gram-moles per liter of said water-based hydraulic fluid of an aromatic compound containing one to three electron-releasing substituent components, wherein said electron-releasing substituents are selected from the group consisting of amino, alkyl-substituted amino having 1 to about 12 carbon atoms, amido groups of the formula —NHC(=O)R wherein R is an alkyl group having 1 to about 12 carbon atoms, alkoxy having 1 to about 12 carbon atoms, and mixtures thereof; with (b) at least about 0.0025 gram-mole per liter of said water-based hydraulic fluid of an aromatic compound containing one to three electron-withdrawing substituent components, wherein said electron-withdrawing substituents are selected from the group consisting of nitro, cyano, sulfo, and mixtures thereof.

2. The water-based hydraulic fluid of claim 1 which contains at least about 20 percent by weight of water.

3. The water-based hydraulic fluid of claim 1 wherein component (a) of said anti-wear agent is a substituted mononuclear benzoic acid compound.

4. The water-based hydraulic fluid of claim 3 wherein said benzoic acid compound is selected from the group consisting of monoaminobenzoic acids; diaminobenzoic acids; mono-(alkoxy-substituted) benzoic acids wherein the carbon atoms in said alkoxy group contains from about 1 to 12 carbon atoms.

5. The water-based hydraulic fluid of claim 3 wherein said benzoic acid compounds are para-substituted benzoic acids.

6. The water-based hydraulic fluid of claim 5 wherein said benzoic acid compound is selected from the group consisting of p-aminobenzoic acid, 3,4-diaminobenzoic acid, p-methoxybenzoic acid and p-n-butoxybenzoic acid.

7. The water-based hydraulic fluid of claim 1 wherein component (a) of said anti-wear agent is a mononuclear para-substituted benzene sulfonic acid compound.

8. The water-based hydraulic fluid of claim 7 wherein component (a) is p-aminobenzenesulfonic acid.

9. The water-based hydraulic fluid of claim 1 wherein component (b) of said anti-wear agent is a substituted mononuclear benzoic acid compound.

10. The water-based hydraulic fluid of claim 9 wherein benzoic acid compound is selected from the group consisting of mononitrobenzoic acid, dinitrobenzoic acid, trinitrobenzoic acid, monocyanobenzoic acid and monosulfobenzoic acid.

11. The water-based hydraulic fluid of claim 10 wherein said benzoic acid compound is a parasubstituted benzoic acid.

12. The water-based hydraulic fluid of claim 11 wherein said benzoic acid compound is selected from the group consisting of p-nitrobenzoic acid and p-cyanobenzoic acid.

13. A method for enhancing the anti-wear properties of water-based hydraulic fluid compositions containing an acidic lubricity agent which comprises incorporating into said hydraulic fluid said anti-wear agent comprising the combination of:

(a) at least about 0.0025 gram-moles per liter of said water-based hydraulic fluid of an aromatic compound containing one to three electron-releasing substituent components, wherein said electron-releasing substituents are selected from the group consisting of amino, alkyl-substituted amino having 1 to about 12 carbon atoms, amido groups of the formula —NHC(=O)R wherein R is an alkyl group having 1 to about 12 carbon atoms, alkoxy having 1 to about 12 carbon atoms, and mixtures thereof; with (b) at least about 0.0025 gram-mole per liter of said water-based hydraulic fluid of an aromatic compound containing one to three electron-withdrawing substituent components, wherein said electron-withdrawing substituents are selected from the group consisting of nitro, cyano, sulfo, and mixtures thereof.

* * * * *